US011538383B2

(12) United States Patent
Tang et al.

(10) Patent No.: US 11,538,383 B2
(45) Date of Patent: Dec. 27, 2022

(54) DRIVING METHOD OF DISPLAY PANEL, DISPLAY PANEL, AND DISPLAY DEVICE

(71) Applicant: KUNSHAN GO-VISIONOX OPTO-ELECTRONICS CO., LTD, Jiangsu (CN)

(72) Inventors: Tao Tang, Kunshan (CN); Xinquan Chen, Kunshan (CN); Xiaobao Zhang, Kunshan (CN)

(73) Assignee: KunShan Go-Visionox Opto-Electronics Co., Ltd, Kunshan (CN)

( * ) Notice: Subject to any disclaimer, the term of this patent is extended or adjusted under 35 U.S.C. 154(b) by 0 days.

(21) Appl. No.: 17/341,779

(22) Filed: Jun. 8, 2021

(65) Prior Publication Data

US 2021/0295759 A1 Sep. 23, 2021

Related U.S. Application Data

(63) Continuation of application No. PCT/CN2019/114232, filed on Oct. 30, 2019.

(30) Foreign Application Priority Data

Apr. 23, 2019 (CN) ..... 201910330201.0

(51) Int. Cl.
*G09G 3/20* (2006.01)
*G09G 3/00* (2006.01)

(52) U.S. Cl.
CPC ..... *G09G 3/20* (2013.01); *G09G 3/006* (2013.01); *G09G 2310/0278* (2013.01); *G09G 2310/0297* (2013.01)

(58) Field of Classification Search
CPC .. G09G 3/20; G09G 3/006; G09G 2310/0278; G09G 2310/0297;
(Continued)

(56) References Cited

U.S. PATENT DOCUMENTS 9,558,705 B2 * 1/2017 Kim ..... G09G 3/3291
10,417,959 B2 * 9/2019 Hyun ..... G09G 3/3225
(Continued)

FOREIGN PATENT DOCUMENTS

CN 104991389 A 10/2015
CN 106097955 A 11/2016
(Continued)

OTHER PUBLICATIONS

Chinese Supplemental Search Report dated Aug. 26, 2021, in connection with corresponding CN Application No. 2019103302010 (4 pp., including machine-generated English translation).
(Continued)

*Primary Examiner* — Jose R Soto Lopez
(74) *Attorney, Agent, or Firm* — Maier & Maier, PLLC

(57) ABSTRACT

A driving method of a display panel is provided. The driving method of the display panel includes: within one frame, in a charging period of sub-pixels electrically connected to an $i^{th}$ scan line, each multiplexing circuit charging N data lines electrically connected to the multiplexing circuit in a charging sequence of a first preset sequence; in a charging period of sub-pixels electrically connected to a $j^{th}$ scan line, each multiplexing circuit charging the N data lines electrically connected to the multiplexing circuit in a charging sequence of a second preset sequence; the second preset sequence is different from the first preset sequence, and charging rankings of each data line electrically connected to each multiplexing circuit in at least two charging sequences are different, where N is an integer and N≥2, and i and j are positive integers and j≠i.

16 Claims, 12 Drawing Sheets

(58) Field of Classification Search
CPC ... G09G 2300/0426; G09G 2300/0452; G09G 2310/08
See application file for complete search history.

(56) References Cited

U.S. PATENT DOCUMENTS

| | | | | |
|---|---|---|---|---|
| 10,657,893 | B2 * | 5/2020 | Mitani | G09G 3/3291 |
| 2006/0123293 | A1 * | 6/2006 | Kim | G09G 3/3291 714/724 |
| 2006/0125738 | A1 * | 6/2006 | Kim | G09G 3/3233 345/76 |
| 2007/0118781 | A1 * | 5/2007 | Kim | G09G 3/3291 714/727 |
| 2007/0242016 | A1 * | 10/2007 | Choi | G09G 3/3233 345/92 |
| 2017/0154562 | A1 * | 6/2017 | Hwang | G09G 3/3291 |
| 2019/0080652 | A1 * | 3/2019 | Kim | G09G 3/3291 |
| 2019/0088185 | A1 * | 3/2019 | Zhang | H01L 27/1214 |
| 2020/0105178 | A1 * | 4/2020 | Han | G09G 3/3659 |
| 2020/0184895 | A1 * | 6/2020 | Zhao | G02F 1/136286 |
| 2021/0118366 | A1 * | 4/2021 | Xuan | G09G 3/3266 |

FOREIGN PATENT DOCUMENTS

| | | | | |
|---|---|---|---|---|
| CN | 107863062 | A | 3/2018 | |
| CN | 108428433 | A | 8/2018 | |
| CN | 108648681 | A * | 10/2018 | G09F 9/00 |
| CN | 108648681 | A | 10/2018 | |
| CN | 108877641 | A | 11/2018 | |
| CN | 109308882 | A | 2/2019 | |
| CN | 109346021 | A | 2/2019 | |
| CN | 109461416 | A | 3/2019 | |
| CN | 109523966 | A | 3/2019 | |
| CN | 109637414 | A | 4/2019 | |
| CN | 109872678 | A | 6/2019 | |
| CN | 110517636 | A * | 11/2019 | G09G 3/3208 |
| JP | 2013050476 | A | 3/2013 | |
| KR | 20080061781 | A | 7/2008 | |

OTHER PUBLICATIONS

Chinese Office Action dated Sep. 3, 2021, in connection with corresponding CN Application No. 201910330201.0 (4 pp., including machine-generated English translation).
International Search Report dated Feb. 10, 2020 in corresponding International application No. PCT/CN2019/114232; 6 pages.
Chinese Office Action dated Feb. 17, 2020 in corresponding application No. 201910330201.0; 23 pages.
Chinese Office Action dated Mar. 26, 2020 in corresponding application No. 201910330201.0; 23 pages.
Chinese Office Action dated May 18, 2020 in corresponding application No. 201910330201.0; 23 pages.
Chinese Office Action dated Dec. 7, 2020 in corresponding application No. 201910330201.0; 15 pages.
Chinese First Search dated Feb. 11, 2020 in corresponding application No. 201910330201.0; 2 pages.
Chinese Supplementary Search dated Nov. 30, 2020 in corresponding application No. 201910330201.0; 1 page.
Chinese Notice of decision of rejection dated Feb. 19, 2021 in corresponding application No. 201910330201.0; 14 pages.
Chinese Notice of decision of rejection dated Jul. 15, 2020 in corresponding application No. 201910330201 0; 16 pages.

* cited by examiner

DRIVING METHOD OF DISPLAY PANEL, DISPLAY PANEL, AND DISPLAY DEVICE

CROSS-REFERENCE TO RELATED APPLICATIONS

This is a continuation of International Patent Application No. PCT/CN2019/114232, filed on Oct. 30, 2019, which claims priority to Chinese Patent Application No. 201910330201.0 filed on Apr. 23, 2019, disclosures of which are incorporated herein by reference in their entireties.

TECHNICAL FIELD

The present disclosure relates to the field of display technologies and, in particular, a driving method of a display panel, a display panel, and a display device.

BACKGROUND

With the continuous development of display technologies, applications of display panels have become more extensive, and requirements of consumers for the display panels also become higher. For example, a development trend of the current display panel is a high refresh frequency to increase a response speed of the display panel. However, with the increase the refresh frequency of the display panel in the related art, columns of sub-pixels in the display panel may be bright alternately, which affects the display quality of the display panel.

SUMMARY

The present application provides a driving method of a display panel and a display device, to avoid the situation that columns of sub-pixels in the display panel are bright alternately, and improve the display quality of the display panel.

According to a first aspect of embodiments of the present disclosure, the present application provides a display panel and a driving method of the display panel. The display panel includes a plurality of multiplexing circuits, a plurality of sub-pixels, and a plurality of data lines and a plurality of scan lines electrically connected to the plurality of sub-pixels respectively; each of the plurality of multiplexing circuits includes N output ends, each of the N output ends of each multiplexing circuit is electrically connected to one data line. The driving method of the display panel includes steps described below. Within one frame, in a charging period of sub-pixels electrically connected to an $i^{th}$ scan line, each multiplexing circuit charges N data lines electrically connected to the N output ends of the multiplexing circuit respectively in a charging sequence of a first preset sequence; and in a charging period of sub-pixels electrically connected to a $j^{th}$ scan line, each multiplexing circuit charges the N data lines electrically connected to the N output ends of the multiplexing circuit respectively in a charging sequence of a second preset sequence; the second preset sequence is different from the first preset sequence, and charging rankings of each data line electrically connected to each multiplexing circuit in at least two charging sequences are different, N is an integer and $N \geq 2$, i and j are positive integers and $j \neq i$.

According to a second aspect of embodiments of the present disclosure, the present application further provides a display device. The display device includes a display panel and a driving chip;

the driving chip is electrically connected to the display panel, and the display panel is the display panel in the above-mentioned embodiments.

DETAILED DESCRIPTION

Figure 1:
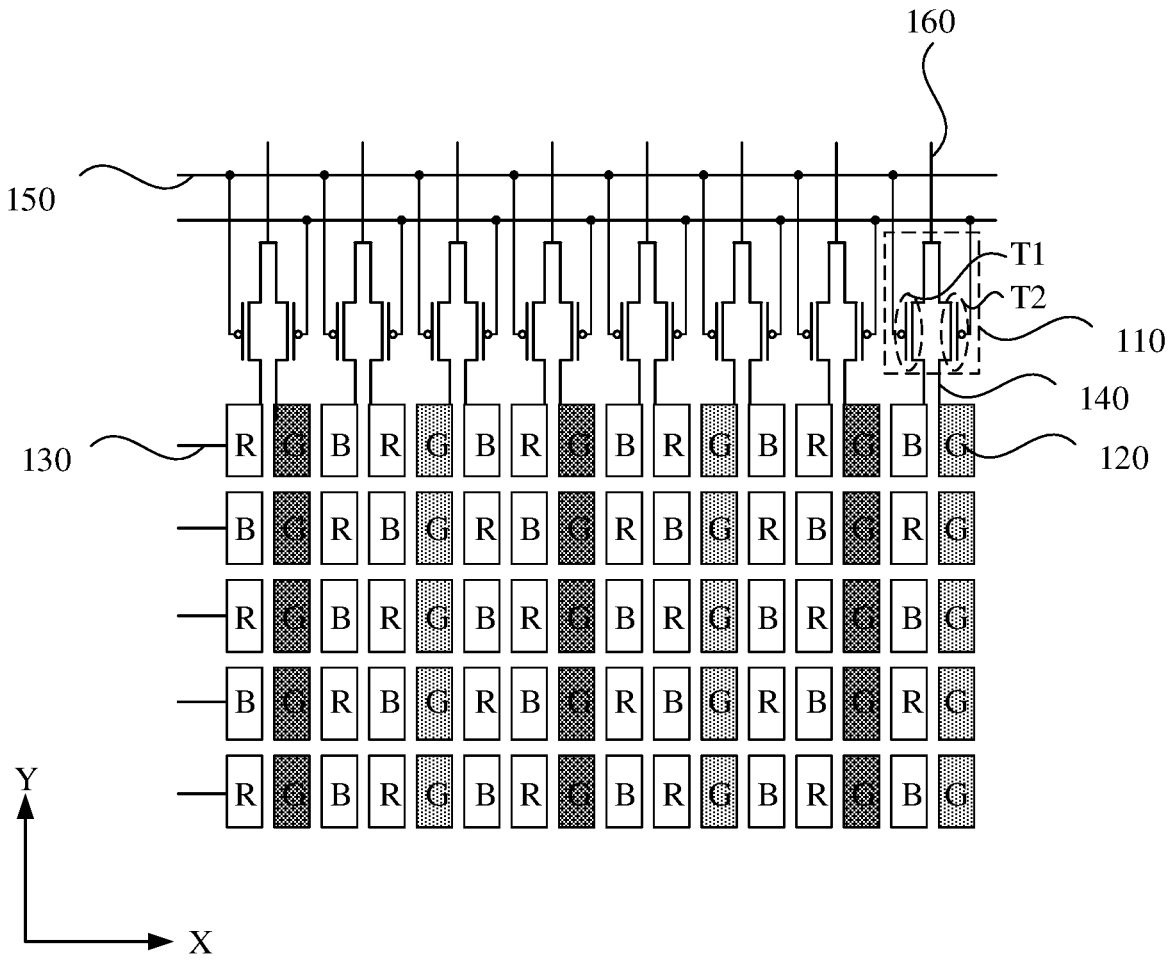
FIG. 1 is a structural diagram of a display panel in the related art.
Figure 2:
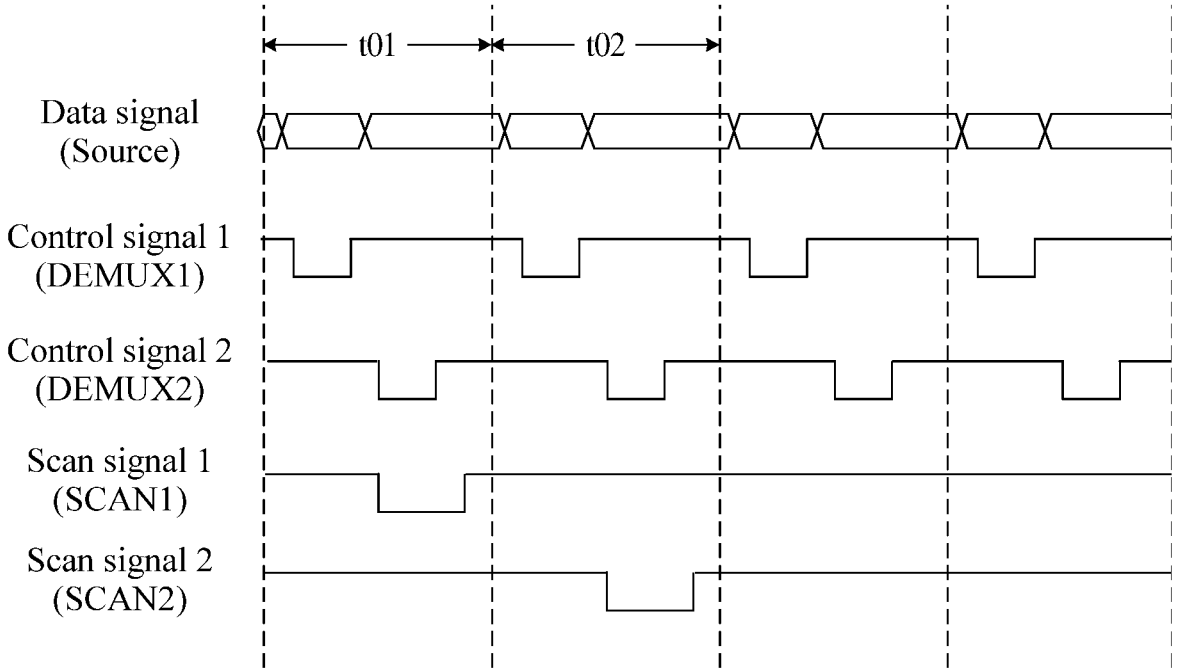
FIG. 2 is a timing diagram of a driving method of a display panel in the related art.

Referring to FIG. 1 and FIG. 2, the display panel includes a plurality of multiplexing circuits 110, a plurality of sub-pixels 120, and a plurality of data lines 130 and a plurality of scan lines 140 electrically connected to the plurality of sub-pixels 120; each multiplexing circuit 110 includes N output ends (exemplarily shown in FIG. 1, each multiplexing circuit 110 includes two output ends), and each of the N output ends of each multiplexing circuit 110 is electrically connected to one data line 140.

The multiplexing circuit 110 includes, for example, an input end, N control ends, and the N output ends. The N control ends of the multiplexing circuit 110 are electrically connected to N clock signal lines 150, the input end is electrically connected to corresponding data connection line 160, and each output end is electrically connected to one data line 140. The multiplexing circuit 110 is configured to transmit data signals of the data connection lines 160 to the N output ends in a time-division manner according to control signals of the clock signal line 150. The multiplexing circuit 110 reduces the quantity of data connection lines 160, thereby reducing the quantity of output channels of a driving chip. There are various arrangements of the multiplexing circuit 110, and one of them is exemplarily shown as in FIG. 1, the multiplexing circuit 110 in FIG. 1 includes two transistors (a transistor T1 and a transistor T2, respectively), the control ends of these two transistors are respectively connected to the clock signal lines 150, first ends of these two transistors are electrically connected to one data connection line 160, and second ends of these two transistors are respectively electrically connected to the data lines 140.

The plurality of scan lines 130 and the plurality of data lines 140 intersect to define the plurality of sub-pixels 120, where the plurality of sub-pixels 120 are arranged in various manners. In FIG. 1, the display panel exemplarily includes red sub-pixels R, green sub-pixels G, and blue sub-pixels B, each scan line 130 is electrically connected to a row of sub-pixels 120, and each data line 140 is electrically connected to a column of sub-pixels 120. The scan lines 130 extend along a row direction X, the data lines 140 extend along a column direction Y, and the scan lines 130 and the data lines 140 intersect to define the plurality of sub-pixels 120 arranged in an array.

In a process of driving the display panel to display, the display image is continuously refreshed, and the time for one refresh is called one frame. Within one frame, the plurality of scan lines 130 sequentially transmit scan signals to the plurality of sub-pixels 120 electrically connected to the plurality of scan lines 130, so that the data signals of the plurality of data lines 140 are sequentially charged to corresponding sub-pixels 120. A charging period (row period) t of the sub-pixels 120 electrically connected to each scan line 130 is equal to (1/refresh frequency)/the quantity of scan lines.

In the related art, the driving method of the display panel is that, within each frame, during a charging period t01 of a first row of sub-pixels 120, a control signal DEMUX1 of a first clock signal line 150 controls the transistor T1 to be turned on first, and a data signal Source of the data connection line 160 charges data lines 140 in odd columns; a control signal DEMUX2 of a second clock signal line 150 controls the transistor T2 to be turned on later, and the data signal Source of the data connection line 160 charges data lines 140 in even columns. At the stage of turning on the transistor T2, a scan signal SCAN1 of a first scan line 130 controls the first row of sub-pixels 120 to be turned on, the data signal Source of the data line 140 charges the first row of sub-pixels 120, and the first row of sub-pixels 120 emit light after the charging completes. Similarly, during a charging period t02 of a second row of sub-pixels 120, the data signal Source of the data connection line 160 charges data lines 140 in odd columns first, and then charges data lines 140 in even columns; when the data lines 140 in even columns are charged, a scan signal SCAN2 of a second scan line 130 controls the second row of sub-pixels 120 to be turned on, and the data signal Source of the data line 140 charges the second row of sub-pixels 120, and the second row of sub-pixels 120 emit light after the charging completes, and so on. That is, during a charging period of each row of sub-pixels 120, the multiplexing circuits 110 charge the data lines 140 in odd columns first, and then charge the data lines 140 in even columns. When the data connection line 160 charges the data lines 140 in even columns, a scan line 130 controls the corresponding row of sub-pixels 120 to be turned on.

Therefore, before the charging of the data signal Source of the data lines 140 in even columns completes, the data signal Source of the data lines 140 in even columns charges the sub-pixels 120; while after the charging of the data signal Source of the data lines 140 in odd column completes, the data signal Source of the data lines 140 in odd column charges the sub-pixels 120, so that the sub-pixels 120 in even columns and the sub-pixels 120 in odd columns have different charging rates and different charging levels. The luminance of the sub-pixels 120 in even columns is darker compared with the sub-pixels 120 in odd columns. Taking the green sub-pixels G in FIG. 1 as an example, the luminance of the green sub-pixels G located in even columns is relatively darker, and the luminance of the green sub-pixels G located in odd columns is relatively brighter. Columns of sub-pixels in the display panel are bright alternately (that is, vertical stripes), thereby affecting the display quality.

Figure 3:
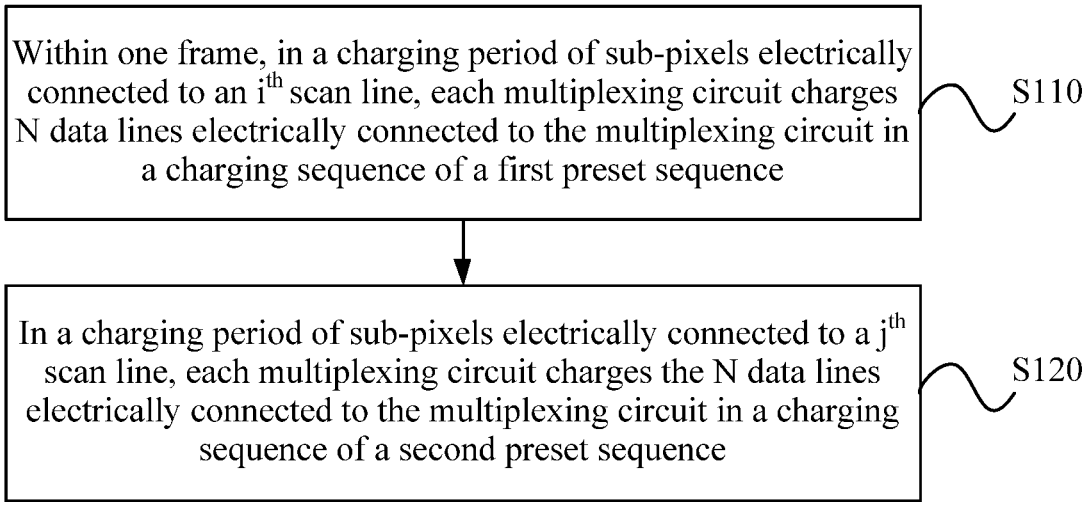
FIG. 3 is a flowchart of a driving method of a display panel according to an embodiment of the present application.

The embodiments of the present application provide a driving method of a display panel. Referring to FIG. 3, the driving method of the display panel includes steps S110 to S120.

In step S110, within one frame, in a charging period of sub-pixels 120 electrically connected to an $i^{th}$ scan line 130, each multiplexing circuit 110 charges N data lines 140 electrically connected to the multiplexing circuit 110 in a charging sequence of a first preset sequence.

In step S120, in a charging period of sub-pixels 120 electrically connected to a $j^{th}$ scan line 130, each multiplexing circuit 110 charges the N data lines 140 electrically connected to the multiplexing circuit 110 in a charging sequence of a second preset sequence.

The second preset sequence is different from the first preset sequence, and charging rankings of each data line 140 electrically connected to each multiplexing circuit 110 in at least two charging sequences are different, N is an integer and $N \geq 2$, i and j are positive integers and $j \neq i$.

The charging period of sub-pixels 120 electrically connected to the scan line 130 refers to that a data signal output by each multiplexing circuit 110 is sequentially written into the N data lines 140, the scan line 130 outputs a scan signal to the sub-pixels 120 electrically connected to the scan line 130, and controls a scan circuit of the sub-pixel 120 to be turned on, and the data signals of the N data lines 140 are written into the scan circuit. That each multiplexing circuit 110 charges the N data lines 140 electrically connected to the multiplexing circuit 110 in the charging sequence of the first or second preset sequence refers to a sequence in which the N output ends of each multiplexing circuit 110 sequentially outputting data signals.

According to the permutation and combination, the opening sequence of the N output ends of each multiplexing circuit 110 includes $A_N^N$ types. For example, N=2, that is, each multiplexing circuit 110 includes two output ends, which are respectively a first output end electrically connected to the data lines 140 in odd columns and a second output end electrically connected to the data lines 140 in even columns. The two output ends of each multiplexing circuit 110 output data signals sequentially in two sequences, a first preset sequence may be that the first output end outputs the data signal first, and the second output end outputs the data signal later; while a second preset sequence may be that the second output end outputs the data signal first, and the first output end outputs the data signal later. For another example, N=3, that is, each multiplexing circuit 110 includes three output ends, which are respectively a first output end electrically connected to the data lines 140 in $(3k+1)^{th}$ columns, a second output end electrically connected to the data lines 140 in $(3k+2)^{th}$ columns, and a third output end electrically connected to the data lines 140 in $(3k+3)^{th}$ columns, where k is a non-negative integer, and the sequence in which the three output ends of the multiplexing circuit 110 outputting the data signals includes 6 types.

The charging rankings of each data line 140 electrically connected to the multiplexing circuit 110 in at least two charging sequences are different means that, for the same data line 140, in a charging period of the sub-pixels 120 electrically connected to at least two scan lines 130, the outputting rankings of the data signals output by the output ends of the multiplexing circuit 110 and transmitted to the data line 140 are different. For example, the multiplexing circuit 110 includes three output ends, the outputting rankings of the data signals output by these output ends include three types, and for the same data line 140, when one row of sub-pixels 120 are scanned, the data line 140 is charged in a first ranking, while the data line 140 is charged in a second ranking or a third ranking when another row of sub-pixels 120 are scanned. That is, for the same data line 140, within one frame, charging rankings of the data line 140 charged by the multiplexing circuit 110 are not exactly the same.

In an embodiment, i is an odd number, j is an even number. In the embodiments of the present application, by exchanging the charging rankings of the data lines every other row, the sub-pixels located in the same row have a bright light-emitting state and a dark light-emitting state, and the sub-pixels located in the same column also have a bright light-emitting state and a dark light-emitting state, so that the brightness complementation is formed, and the phenomenon of "vertical stripes" in vision due to uneven charging is eliminated.

Figure 4:
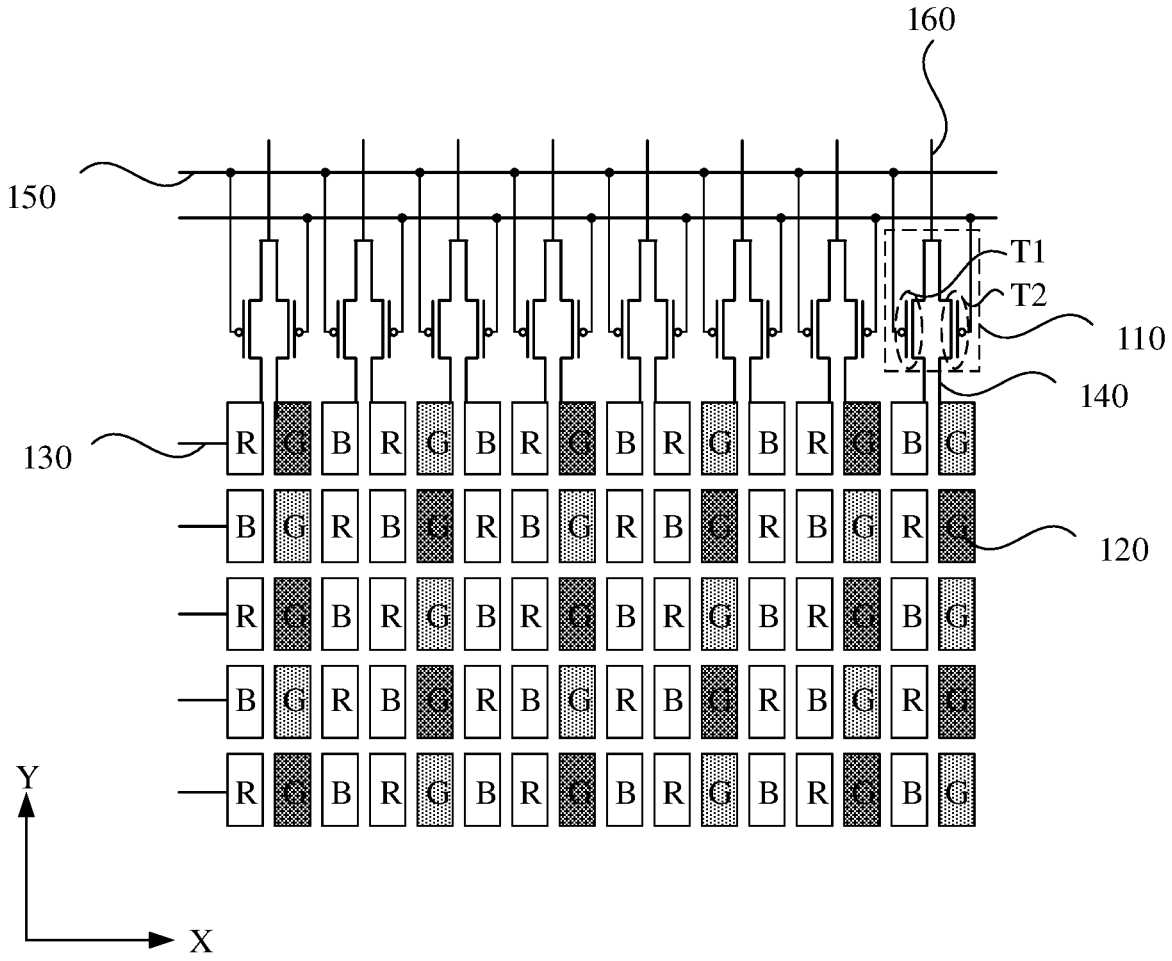
FIG. 4 is a schematic diagram of the luminance of the sub-pixels of the display panel shown in FIG. 3 according to an embodiment of the present application.
Figure 5:
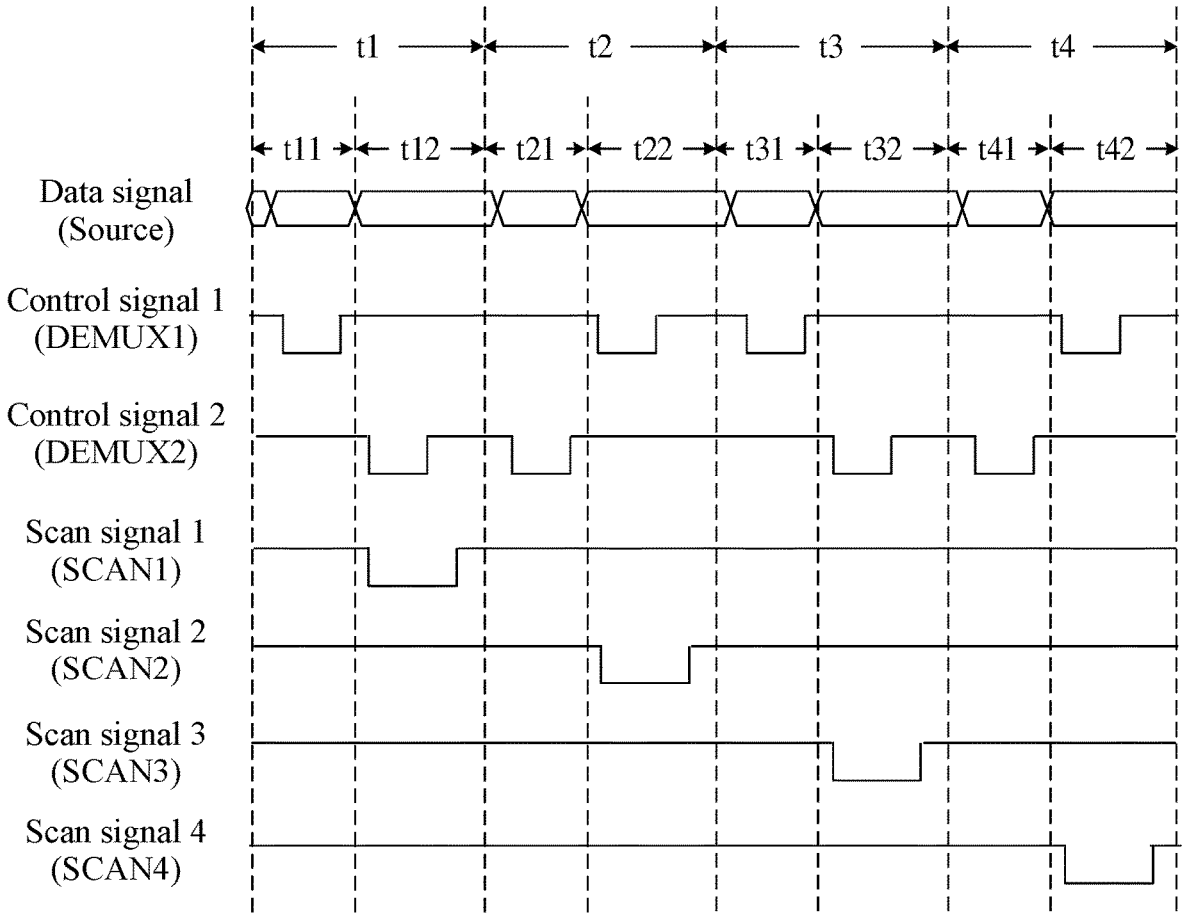
FIG. 5 is a timing diagram of a driving method of the display panel shown in FIG. 3 according to an embodiment of the present application.

The driving method of the display panel according to an embodiment of the present application will be described by taking that N=2, i is an odd number, and j is an even number as an example. Referring to FIGS. 4 and 5, exemplarily, within one frame:

a charging period t1 of a first row of sub-pixels 120 includes two time periods t11 and t12.

Within the time period t11, the first clock signal line 150 controls the first transistor T1 of the multiplexing circuit 110 to be turned on, and the second clock signal line 150 controls the second transistor T2 of the multiplexing circuit 110 to be turned off, that is, the data lines 140 in odd columns are charged first, and the charging ranking of the data lines 140 in odd columns within the charging period t1 of the first row of sub-pixels 120 is the first ranking.

Within the time period t12, the first clock signal line 150 controls the first transistor T1 of the multiplexing circuit 110 to be turned off, and the second clock signal line 150 controls the second transistor T2 of the multiplexing circuit 110 to be turned on, that is, the data lines 140 in even columns are charged later, and the charging ranking of the data lines 140 in even columns within the charging period t1 of the first row of sub-pixels 120 is the second ranking. A scan signal SCAN1 of the first scan line 130 controls the first row of sub-pixels 120 to be turned on and the first row of sub-pixels 120 are charged.

Within the charging period t1 of the first row of sub-pixels 120, the charging ranking of the data lines 140 in odd columns is the first ranking, and the charging ranking of the data lines 140 in even columns is the second ranking, that is, the charging ranking of the data lines 140 in odd columns is ahead of that of the data lines 140 in even columns. The data lines 140 in odd columns charge the sub-pixels 120 after the charging of the data signal Source is completed, while the data lines 140 in even columns charge the sub-pixels 120 before the charging of the data signal Source is completed, that is, the data lines 140 in even columns charges the sub-pixels 120 correspondingly connected to the data lines 140 in even columns before the charging of the data lines 140 in even columns is completed. In this way, in the first row, the charging rate of the sub-pixels 120 located in even columns is lower than the charging rate of the sub-pixel 120 located in odd columns. Therefore, taking the green sub-pixels G as an example, the luminance of the green sub-pixels G located in even columns is relatively darker, and the luminance of the green sub-pixels G located in odd columns is relatively brighter.

A charging period t2 of a second row of sub-pixels 120 includes two time periods t21 and t22.

Within the time period t21, the first clock signal line 150 controls the first transistor T1 of the multiplexing circuit 110 to be turned off, and the second clock signal line 150 controls the second transistor T2 of the multiplexing circuit 110 to be turned on, that is, the data lines 140 in even columns are charged first, and the charging ranking of the data lines 140 in even columns within the charging period t2 of the second row of sub-pixels 120 is the first ranking.

Within the time period t22, the first clock signal line 150 controls the first transistor T1 of the multiplexing circuit 110 to be turned on, and the second clock signal line 150 controls the second transistor T2 of the multiplexing circuit 110 to be turned off, that is, the data lines 140 in odd columns are charged later, and the charging ranking of the data lines 140 in odd columns within the charging period t2 of the second row of sub-pixels 120 is the second ranking; a scan signal SCAN2 of the second scan line 130 controls the second row of sub-pixels 120 to be turned on and the second row of sub-pixels 120 are charged.

Within the charging period t2 of the second row of sub-pixels 120, the charging ranking of the data lines 140 in odd columns is the second ranking, and the charging ranking of the data lines 140 in even columns is the first ranking, that is, the charging ranking of the data lines 140 in even columns is ahead of the charging ranking of the data lines 140 in odd columns. The data lines 140 in even columns charge the sub-pixels 120 after the charging of the data signal Source is completed, while the data lines 140 in odd columns charge the sub-pixels 120 before the charging of the data signal Source is completed, that is, the data lines 140 in odd columns charges the sub-pixels 120 correspondingly connected to the data lines 140 in odd columns before the charging of the data lines 140 in odd columns is completed. In this way, in the second row, the charging rate of the sub-pixels 120 located in even columns is higher than the charging rate of the sub-pixels 120 located in odd columns. Therefore, taking the green sub-pixels G as an example, the luminance of the green sub-pixels G located in even columns is relatively brighter, and the luminance of the green sub-pixels G located in odd columns is relatively darker.

A charging period t3 of a third row of sub-pixels 120 includes two time periods t31 and t32.

Within the time period t31, the first clock signal line 150 controls the first transistor T1 of the multiplexing circuit 110 to be turned on, and the second clock signal line 150 controls the second transistor T2 of the multiplexing circuit 110 to be turned off, that is, the data lines 140 in odd columns are charged first, and the charging ranking of the data lines 140 in odd columns within the charging period t3 of the third row of sub-pixels 120 is the first ranking.

Within the time period t32, the first clock signal line 150 controls the first transistor T1 of the multiplexing circuit 110 to be turned off, and the second clock signal line 150 controls the second transistor T2 of the multiplexing circuit 110 to be turned on, that is, the data lines 140 in even columns are charged later, and the charging ranking of the data lines 140 in even columns within the charging period t3 of the third row of sub-pixels 120 is the second ranking; a scan signal SCAN3 of the third scan line 130 controls the third row of sub-pixels 120 to be turned on and the third row of sub-pixels 120 are charged.

Similarly, it can be seen that in the third row, the charging rate of the sub-pixels 120 located in even columns is lower than the charging rate of the sub-pixels 120 located in odd columns. Therefore, taking the green sub-pixels G as an example, the luminance of the green sub-pixels G located in even columns is relatively darker, and the luminance of the green sub-pixels G located in odd columns is relatively brighter.

A charging period t4 of a fourth row of sub-pixels 120 includes two time periods t41 and t42.

Within the time period t41, the first clock signal line 150 controls the first transistor T1 of the multiplexing circuit 110 to be turned on, and the second clock signal line 150 controls the second transistor T2 of the multiplexing circuit 110 to be turned off, that is, the data lines 140 in odd columns are charged first, and the charging ranking of the data lines 140 in odd columns within the charging period t4 of the fourth row of sub-pixels 120 is the first ranking.

Within the time period t42, the first clock signal line 150 controls the first transistor T1 of the multiplexing circuit 110 to be turned off, and the second clock signal line 150 controls the second transistor T2 of the multiplexing circuit 110 to be turned on, that is, the data lines 140 in even columns are charged later, and the charging ranking of the data lines 140 in even columns within the charging period t4 of the fourth row of sub-pixels 120 is the second ranking; a scan signal SCAN4 of the fourth scan line 130 controls the fourth row of sub-pixels 120 to be turned on and the fourth row of sub-pixels 120 are charged.

Similar to the above, it can be seen that in the fourth row, the charging rate of the sub-pixels 120 located in even columns is higher than the charging rate of the sub-pixels 120 located in odd columns. Therefore, taking the green sub-pixels G as an example, the luminance of the green sub-pixels G located in even columns is relatively brighter, and the luminance of the green sub-pixels G located in odd columns is relatively darker.

Thus, in the embodiments of the present application, by exchanging the charging rankings of the data lines every other row, the charging rate of the sub-pixels 120 located in odd columns changes every other row, and the charging rate of the sub-pixels 120 located in even columns also changes every other row, which is conducive to the balance of the overall charging rate of the sub-pixels 120 of the display panel, and the overall charging degree tends to be consistent. From the luminance of sub-pixels, green sub-pixels G in the same row have a state of brightness alternating with darkness, and green sub-pixels G in the same column may also have a state of brightness alternating with darkness, so that brightness complementation is formed, and the phenomenon of "vertical stripes" in vision due to uneven charging is eliminated.

In the embodiments of the present application, charging rankings of each data line 140 electrically connected to the multiplexing circuit 110 in at least two charging sequences are different, so that the sub-pixels 120 electrically connected to the same data line 140 have different luminance to form the brightness complementation. Since the sub-pixel 120 is very small, a single sub-pixel 120 is visually indistinguishable, compared to the related art, the embodiments of the present application do not have the phenomenon of "vertical stripes which are macroscopical", thereby improving the display quality of the display panel. Moreover, the embodiments of the present application are not limited by the arrangement of the pixels, and the luminance of brightness alternating with darkness of sub-pixels 120 electrically connected to the same data line 140 can be implemented for different arrangements of the pixels, the phenomenon of "vertical stripes which are macroscopical" does not exist. In addition, the turning on of the sub-pixels 120 and the charging of the data lines 140 can be implemented simultaneously on the premise of the high display quality in the embodiment of the present application, which is conducive to reducing the row period and improving the response speed, thus suitable for the display panel with a high refresh rate and the high display quality.

It should be noted that in the above embodiment, that n=2, i is an odd number and j is an even number is not limited to the present application. In other embodiments, N, i, and j may be set to other situations, which may be limited according to a requirement of a practical application. Several typical situations are described below, which do not limit the present application.

Figure 6:
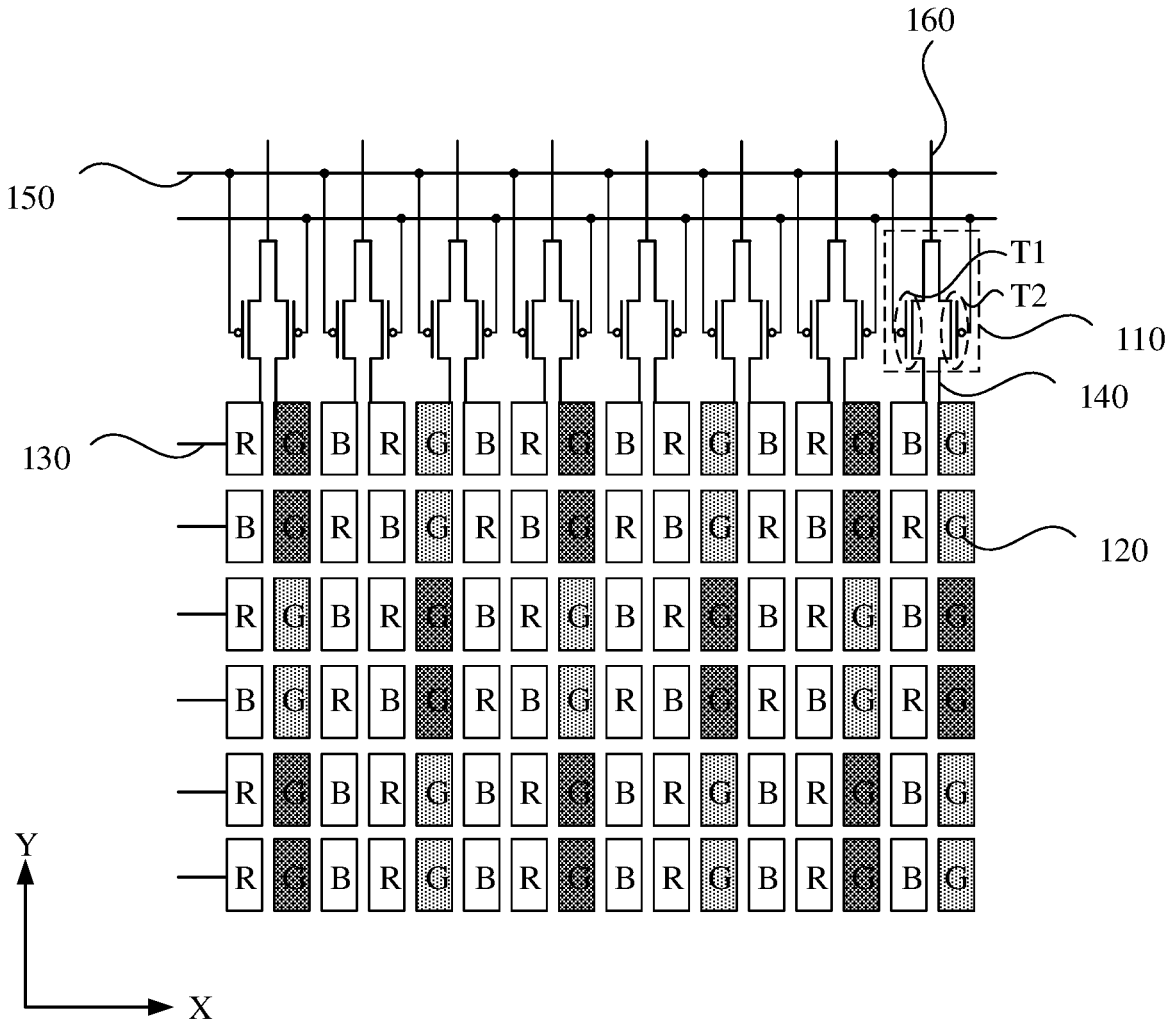
FIG. 6 is a schematic diagram of the luminance of the sub-pixels of a display panel on which a charging sequence of the N data lines electrically connected to the multiplexing circuit charged by the multiplexing circuit changes once every k scan lines based on the driving method shown in FIG. 3 according to an embodiment of the present application.
Figure 7:
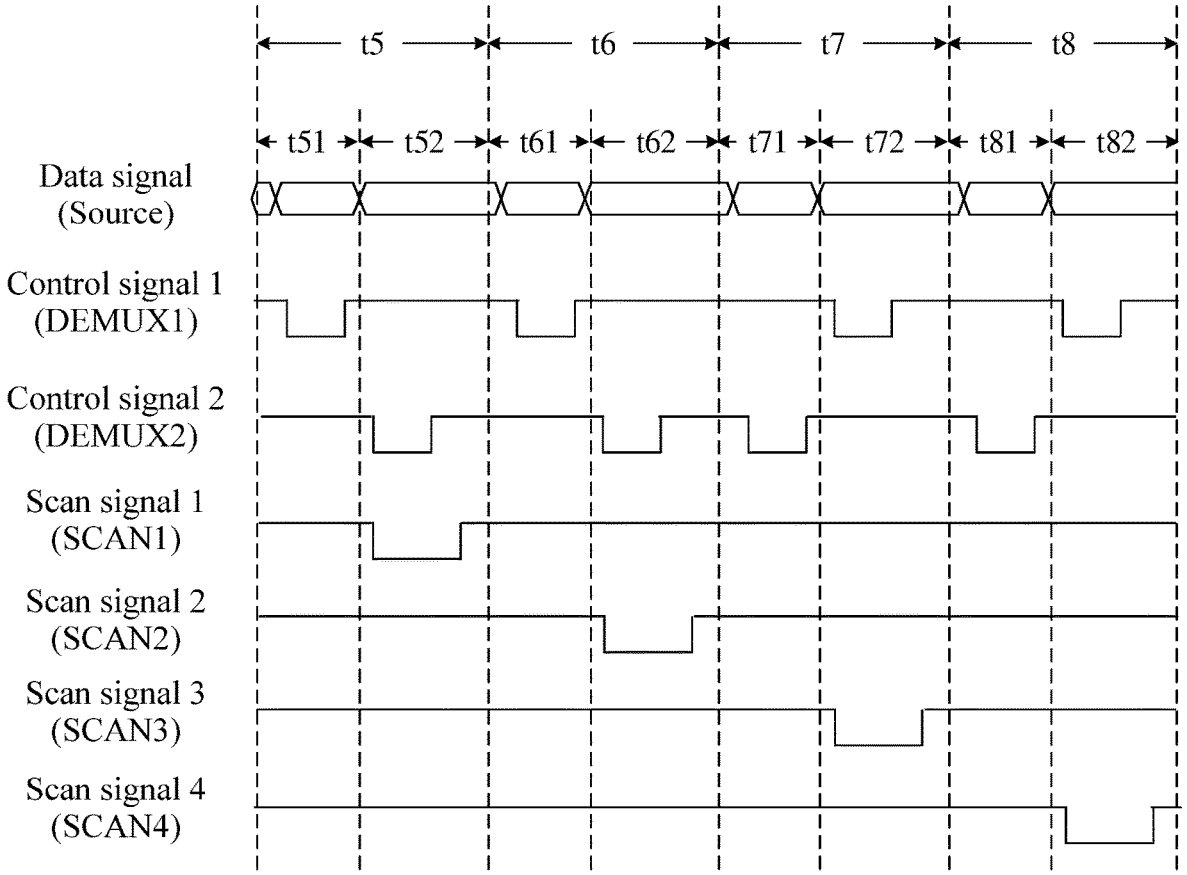
FIG. 7 is a timing diagram of a driving method of the display panel shown in FIG. 6 according to an embodiment of the present application.

Referring to FIG. 6 and FIG. 7, this embodiment is a variation on the basis of the embodiment described in FIG. 4 and FIG. 5. The only difference is that a charging sequence of the N data lines charged by the multiplexing circuit which is electrically connected to the N data lines changes once every k scan lines, where k is an integer larger than 1.

The charging sequence of the data lines 140 changes once every k scan lines means that in a charging period of the sub-pixels 120 electrically connected to adjacent k scan lines 130, the multiplexing circuit 110 charges the N data lines 140 electrically connected to the multiplexing circuit 110 in the same charging sequence. A value of k may be 2, 3, 4, 5, 6, 7, 8, 9, 10, or etc. exemplarily, $k \leq 8$, that is, the smaller the value of k is, the more fine the display panel is. Since one sub-pixel 120 is very small, two or more adjacent sub-pixels 120 are visually indistinguishable, compared to the related art, the embodiment of the present application do not have the phenomenon of "vertical stripes which are macroscopical", thereby improving the display quality of the display panel.

Exemplarily, taking that N=2, i is an odd number, j is an even number, and k=2 as an example, that is, the charging sequence of two data lines 140 charged by the multiplexing circuit 110 which is electrically connected to the two data lines 140 changes once every 2 scan lines. Within one frame:

a charging period t5 of the first row of sub-pixels 120 includes two time periods t51 and t52. Within the time period t51, the data lines 140 in odd columns are charged first; within the time period t52, the data lines 140 in even columns are charged later. The scan signal SCAN1 of the first scan line 130 controls the first row of sub-pixels 120 to be turned on and the first row of sub-pixels 120 are charged. The charging rate of the sub-pixels 120 located in even columns is lower than the charging rate of the sub-pixels 120 located in odd columns. Therefore, taking the green sub-pixels G as an example, the luminance of the green sub-pixels G located in even columns is relatively darker, and the luminance of the green sub-pixels G located in odd columns is relatively brighter.

A charging period t6 of the second row of sub-pixels 120 includes two time periods t61 and t62. Within the time period t61, the data lines 140 in odd columns are charged first; within the time period t62, the data lines 140 in even columns are charged later. The scan signal SCAN2 of the second scan line 130 controls the second row of sub-pixels 120 to be turned on and the second row of sub-pixels 120 are charged. The charging rate of the sub-pixels 120 located in even columns is lower than the charging rate of the sub-pixels 120 located in odd columns Therefore, taking the green sub-pixels G as an example, the luminance of the green sub-pixels G located in even columns is relatively darker, and the luminance of the green sub-pixels G located in odd columns is relatively brighter.

A charging period t7 of the third row of sub-pixels 120 includes two time periods t71 and t72. Within the time period t71, the data lines 140 in even columns are charged first; within the time period t72, the data lines 140 in odd columns are charged later. The scan signal SCAN3 of the third scan line 130 controls the third row of sub-pixels 120 to be turned on and the third row of sub-pixels 120 are charged. The charging rate of the sub-pixels 120 located in even columns is higher than the charging rate of the sub-pixels 120 located in odd columns. Therefore, taking the green sub-pixels G as an example, the luminance of the green sub-pixels G located in even columns is relatively brighter, and the luminance of the green sub-pixels G located in odd columns is relatively darker.

A charging period t8 of the fourth row of sub-pixels 120 includes two time periods t81 and t82. Within the time period t81, the data lines 140 in odd columns are charged first; within the time period t82, the data lines 140 in even columns are charged later. The scan signal SCAN4 of the fourth scan line 130 controls the fourth row of sub-pixels 120 to be turned on and the fourth row of sub-pixels 120 are charged. The charging rate of the sub-pixels 120 located in even columns is higher than the charging rate of the sub-pixels 120 located in odd columns. Therefore, taking the green sub-pixels G as an example, the luminance of the green sub-pixels G located in even columns is relatively darker, and the luminance of the green sub-pixels G located in odd columns is relatively brighter.

In a fifth row and a sixth row, the charging rate of the sub-pixels 120 located in even columns is lower than the charging rate of the sub-pixels 120 located in odd columns. Therefore, taking the green sub-pixels G as an example, the luminance of the green sub-pixels G located in even columns is relatively darker, and the luminance of the green sub-pixels G located in odd columns is relatively brighter.

In a seventh row and an eighth row, the charging rate of the sub-pixels 120 located in even columns is higher than the charging rate of the sub-pixels 120 located in odd columns. Therefore, taking the green sub-pixels G as an example, the luminance of the green sub-pixels G located in even columns is relatively brighter, and the luminance of the green sub-pixels G located in odd columns is relatively darker.

In this way, according to the embodiments of the present application, the charging sequence of the N data lines 140 charged by the multiplexing circuit which is electrically connected to the N data lines 140 changes once every two scan lines 130. By exchanging the charging rankings of every two rows of the data lines 140, the overall charging rate of the sub-pixels 120 in both odd columns and even columns is more balanced, and the overall charging degree tends to be consistent.

Figure 8:
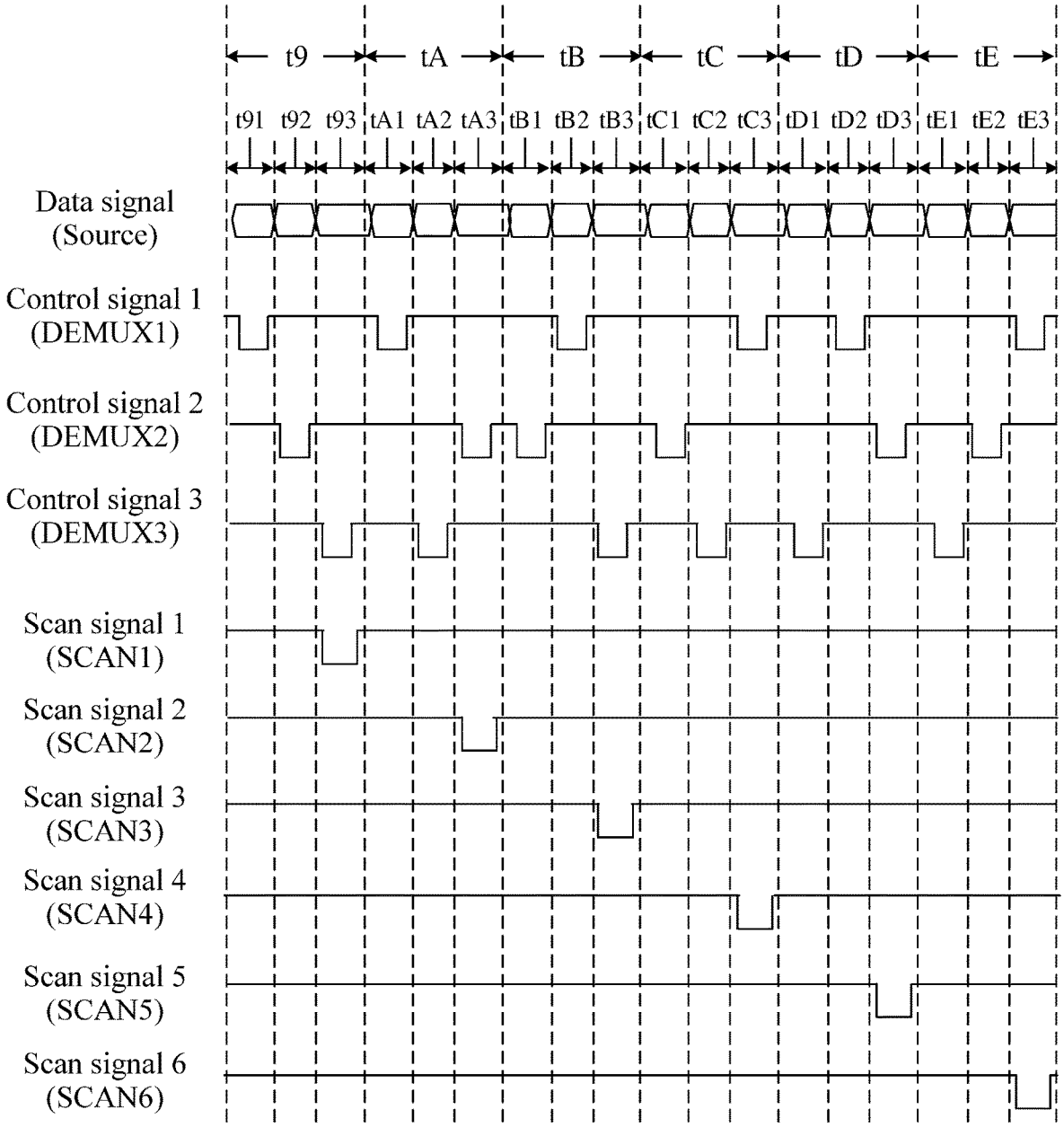
FIG. 8 is a timing diagram of a driving method of a display panel on which a charging sequence of the N data lines electrically connected to the multiplexing circuit charged by the multiplexing circuit repeats once every $(A_N^N+1)$ scan lines based on the driving method shown in FIG. 3 according to an embodiment of the present application.

Referring to FIG. 8, this embodiment is a variation on the basis of the embodiment described in FIG. 4 and FIG. 5. The only difference is that a charging sequence of the N data lines charged by the multiplexing circuit 110 which is electrically connected to the N data lines repeats once every $(A_N^N+1)$ scan lines 130.

Repeating once every $(A_N^N+1)$ scan lines 130 means that in the charging periods of the sub-pixels 120 of adjacent $A_N^N$ scan lines 130, the types of the charging sequence of the N data lines 140 charged by the multiplexing circuit 110 which is electrically connected to the N data lines are different. For example, N=3, the charging sequence includes six types. In the charging periods of the sub-pixels 120 of adjacent six scan lines 130, the charging sequence of three data lines 140 charged by the multiplexing circuit 110 which is electrically connected to three data lines includes six types and repeats once every seven scan lines 130.

Exemplarily, N=3 is taken as an example for describing. Within one frame:

a charging period t9 of the first row of sub-pixels 120 includes three time periods t91, t92, and t93. Within the time period t91, a charging ranking of data lines 140 of $(3m+1)^{th}$ columns in the charging period t9 of the first row of sub-pixels 120 is the first ranking, and m is a non-negative integer. Within the time period t92, a charging ranking of data lines 140 of $(3m+2)^{th}$ columns in the charging period t9 of the first row of sub-pixels 120 is the second ranking. Within the time period t93, a charging ranking of data lines 140 of $(3m+3)^{th}$ columns in the charging period t9 of the first row of sub-pixels 120 is the third ranking; the scan signal SCAN1 of the first scan line 130 controls the first row of sub-pixels 120 to be turned on and the first row of sub-pixels 120 are charged.

A charging period tA of the second row of sub-pixels 120 includes three time periods tA1, tA2 and tA3. Within the time period tA1, the charging ranking of the data lines 140 of $(3m+1)^{th}$ columns in the charging period tA of the second row of sub-pixels 120 is the first ranking. Within the time period tA2, the charging ranking of the data lines 140 of $(3m+3)^{th}$ columns in the charging period tA of the second row of sub-pixels 120 is the second ranking. Within the time period tA3, the charging ranking of the data lines 140 of $(3m+2)^{th}$ columns in the charging period tA of the second row of sub-pixels 120 is the third ranking; the scan signal SCAN2 of the second scan line 130 controls the second row of sub-pixels 120 to be turned on and the second row of sub-pixels 120 are charged.

A charging period tB of the third row of sub-pixels 120 includes three time periods tB1, tB2, and tB3. Within the time period tB1, the charging ranking of the data lines 140 of $(3m+2)^{th}$ columns in the charging period tB of the third row of sub-pixels 120 is the first ranking; within the time period tB2, the charging ranking of the data lines 140 of $(3m+1)^{th}$ columns in the charging period tB of the third row of sub-pixels 120 is the second ranking; within the time period tB3, the charging ranking of the data lines 140 of $(3m+3)^{th}$ columns in the charging period tB of the third row of sub-pixels 120 is the third ranking. The scan signal SCAN3 of the third scan line 130 controls the third row of sub-pixels 120 to be turned on and the third row of sub-pixels 120 are charged.

A charging period tC of the fourth row of sub-pixels 120 includes three time periods tC1, tC2 and tC3. Within the time period tC1, the charging ranking of the data lines 140 of $(3m+2)^{th}$ columns in the charging period tC of the fourth row of sub-pixels 120 is the first ranking; within the time period tC2, the charging ranking of the data lines 140 of $(3m+3)^{th}$ columns in the charging period tC of the fourth row of sub-pixels 120 is the second ranking; within the time period tC3, the charging ranking of the data lines 140 of $(3m+1)^{th}$ columns in the charging period tC of the fourth row of sub-pixels 120 is the third ranking. The scan signal SCAN4 of the fourth scan line 130 controls the fourth row of sub-pixels 120 to be turned on and the fourth row of sub-pixels 120 are charged.

A charging period tD of the fifth row of sub-pixels 120 includes three time periods tD1, tD2, and tD3. Within the time period tD1, the charging ranking of the data lines 140 of $(3m+3)^{th}$ columns in the charging period tD of the fifth row of sub-pixels 120 is the first ranking; within the time period tD2, the charging ranking of the data lines 140 of $(3m+1)^{th}$ columns in the charging period tD of the fifth row of sub-pixels 120 is the second ranking; within the time period tD3, the charging ranking of the data lines 140 of $(3m+2)^{th}$ columns in the charging period tD of the fifth row of sub-pixels 120 is the third ranking. A scan signal SCAN5 of the fifth scan line 130 controls the fifth row of sub-pixels 120 to be turned on and the fifth row of sub-pixels 120 are charged.

A charging period tE of the sixth row of sub-pixels 120 includes three time periods tE1, tE2, and tE3. Within the time period tE1, the charging ranking of the data lines 140 of $(3m+3)^{th}$ columns in the charging period tE of the sixth row of sub-pixels 120 is the first ranking; within the time period tE2, the charging ranking of the data lines 140 of $(3m+2)^{th}$ columns in the charging period tE of the sixth row of sub-pixels 120 is the second ranking; within the time period tE3, the charging ranking of the data lines 140 of $(3m+1)^{th}$ columns in the charging period tE of the sixth row of sub-pixels 120 is the third ranking. A scan signal SCAN6 of the sixth scan line 130 controls the sixth row of sub-pixels 120 to be turned on and the sixth row of sub-pixels 120 are charged.

By repeating the driving manner of first six rows, the refresh of the entire display panel is completed. In the embodiments of the present application, the charging sequence of the N data lines 140 charged by the multiplexing circuit 110 which is electrically connected to the N data lines repeats once every $(A_N^N+1)$ scan lines 130, which makes the overall charging rate of sub-pixels 120 in the same column more balanced and the overall charging degree tend to be consistent.

In an embodiment, $N \leq 6$. By this setting in the embodiment of the present application, the quantity of output ends of the multiplexing circuit 110 is relatively fewer, which is conducive to making charging time of the data lines 140 more sufficient.

It should be noted that in the above embodiments, it is exemplarily shown that in a charging period of the sub-pixels 120 electrically connected to each scan line 130, when each multiplexing circuit 110 charges a data line 140 of a last charging ranking in the charging sequence, the scan driving circuit sends a scan signal to the scan line 130 to control the sub-pixels 120 electrically connected to the scan line 130 to be charged, which does not limit the present application. By this setting in the embodiment of the present application, the row period can be shortened, which is conducive to implementing the high refresh frequency of the display panel. In other embodiments, the scan driving circuit may also send the scan signal to each scan line 130 at other time, so as to control the sub-pixels 120 electrically connected to the scan line 130 to be charged, which may be set according to requirement of a practical application.

Figure 9:
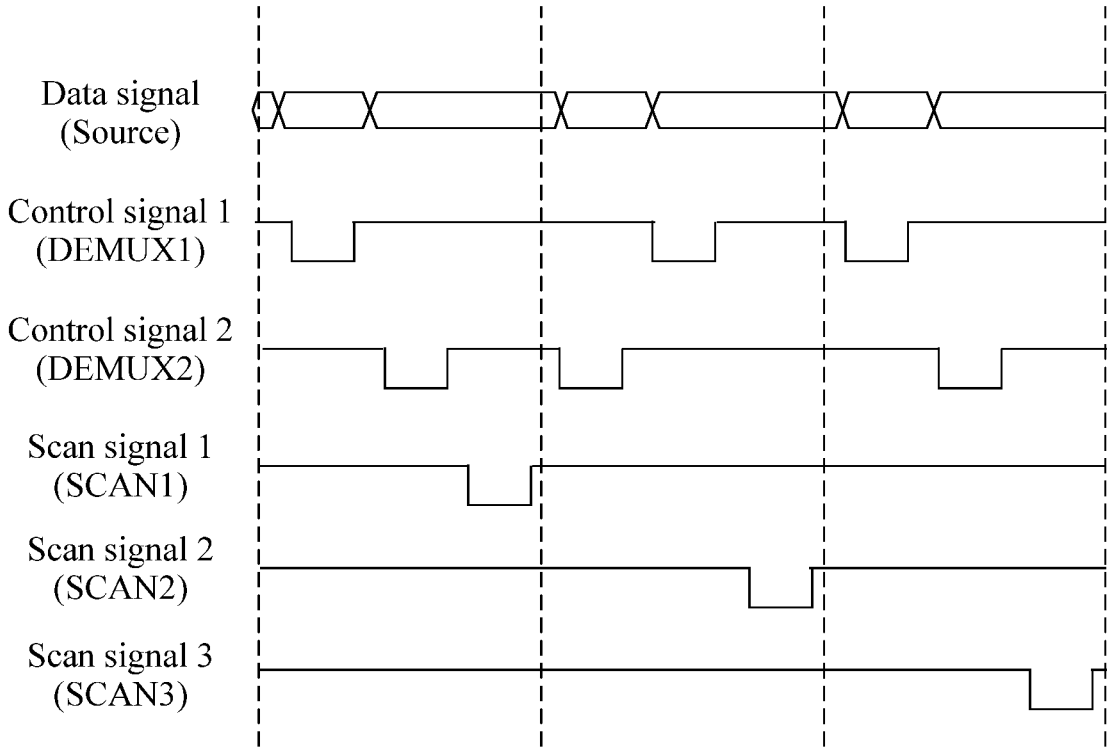
FIG. 9 is a timing diagram of a driving method of a display panel on which after each multiplexing circuit charges the N data lines electrically connected to each multiplexing circuit, a scan driving circuit sends a scan signal to each of the plurality of scan lines based on the driving method shown in FIG. 3 according to an embodiment of the present application.

Referring to FIG. 9, in an embodiment, after each multiplexing circuit 110 charges the N data lines 140 electrically connected to the multiplexing circuit 110, the scan driving circuit sends a scan signal to each scan line 130 to control the sub-pixels 120 electrically connected to the scan line 130 to be charged. By this setting in the embodiment of the present application, the data signal of the data lines 140 which is in a state of charging completion can charge the sub-pixels 120, which is conducive to making the charging rates of the sub-pixels 120 electrically connected to the data lines 140 to be same and the charging degrees of the sub-pixels 120 electrically connected to the data lines 140 to be consistent.

Figure 10:
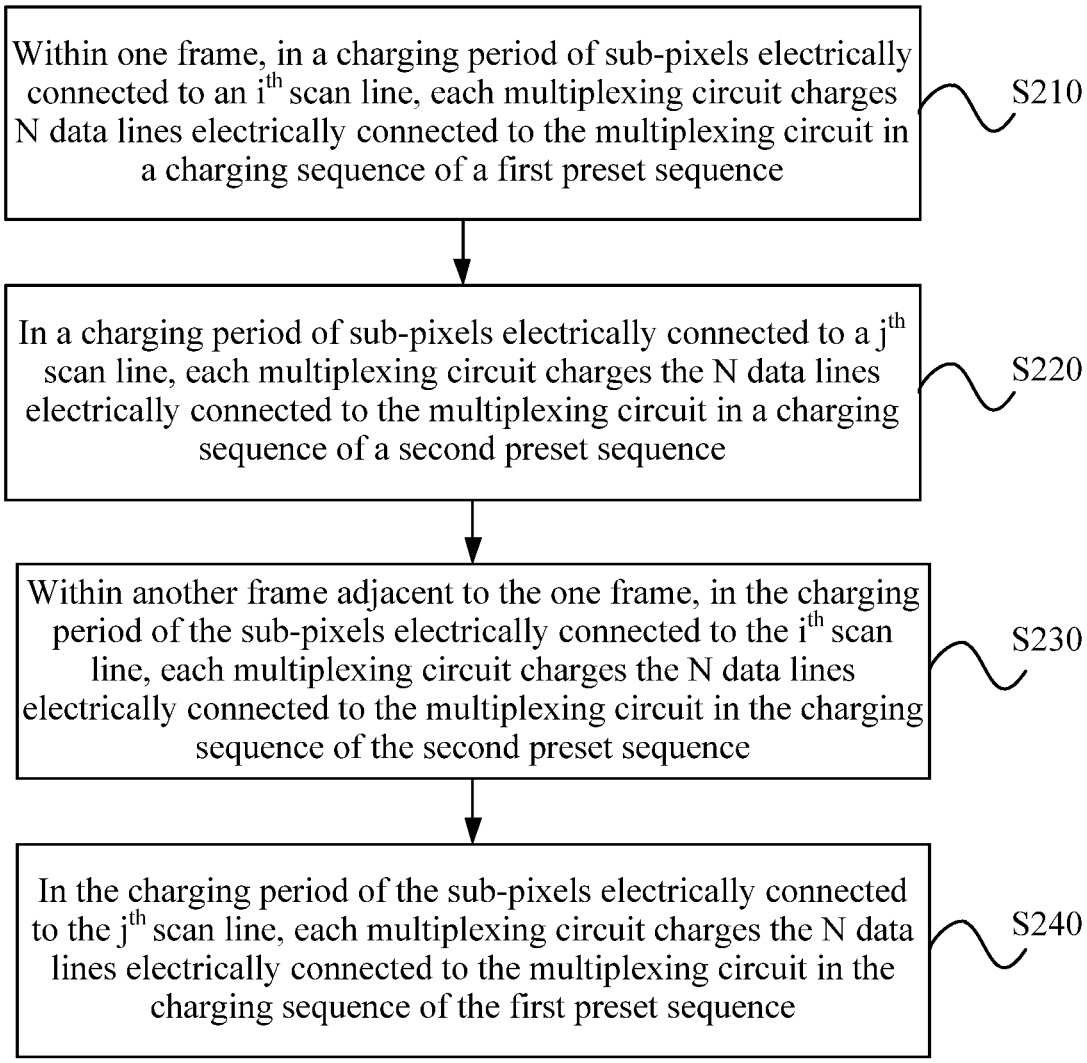
FIG. 10 is a flowchart of a driving method of a display panel on which charging rankings of each data line electrically connected to each multiplexing circuit in at least two charging sequences are different based on the driving method shown in FIG. 3 according to an embodiment of the present application.

Referring to FIG. 10, the driving method of the display panel includes steps S210 to S240.

In step S210, within one frame, in a charging period of the sub-pixels 120 electrically connected to an $i^{th}$ scan line 130, each multiplexing circuit 110 charges N data lines 140 electrically connected to the multiplexing circuit 110 in a charging sequence of a first preset sequence.

In step S220, in a charging period of the sub-pixels 120 electrically connected to a $j^{th}$ scan line 130, each multiplexing circuit 110 charges the N data lines 140 electrically connected to the multiplexing circuit 110 in a charging sequence of a second preset sequence.

In step S230, within another frame adjacent to the one frame, in the charging period of the sub-pixels 120 electrically connected to the $i^{th}$ scan line 130, each multiplexing circuit 110 charges the N data lines 140 electrically connected to the multiplexing circuit 110 in the charging sequence of the second preset sequence.

In step S240, in the charging period of sub-pixel 120 electrically connected to the $j^{th}$ scan line 130, each multiplexing circuit 110 charges the N data lines 140 electrically connected to the multiplexing circuit 110 in the charging sequence of the first preset sequence.

The second preset sequence is different from the first preset sequence, and charging rankings of each data line 140 electrically connected to the multiplexing circuit 110 in at least two charging sequences are different, N is an integer and $N \geq 2$, and i and j are positive integers and $j \neq i$.

Figure 11:
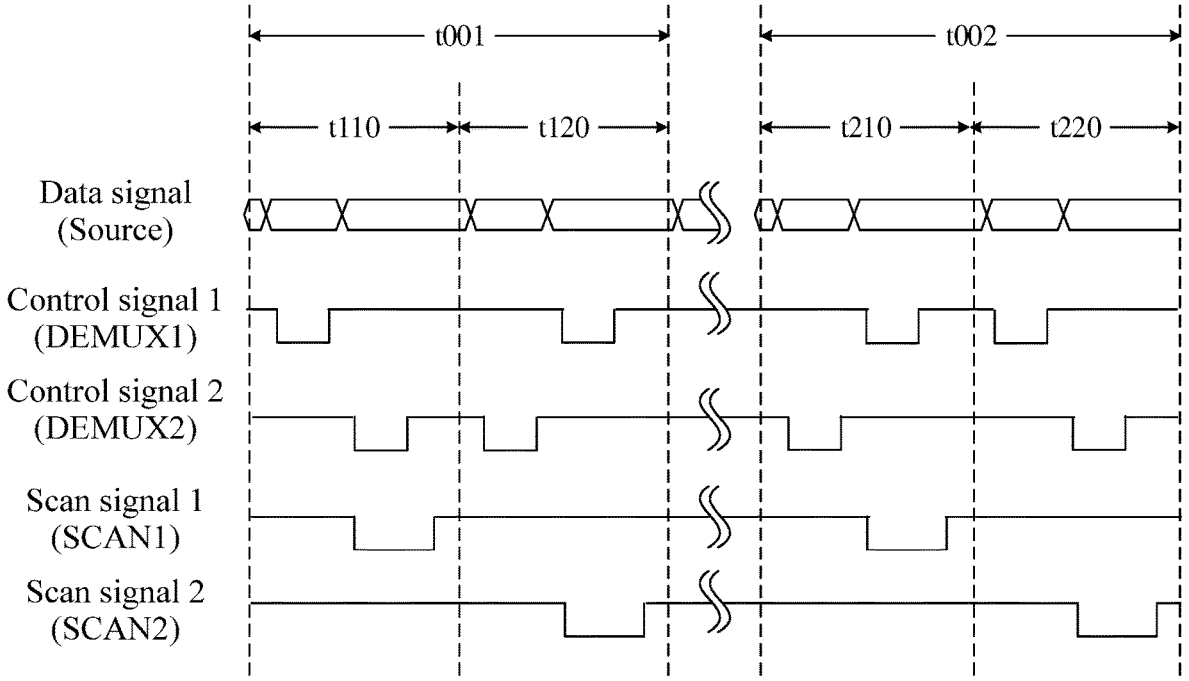
FIG. 11 is a timing diagram of the driving method of the display panel shown in FIG. 10 according to an embodiment of the present application.

The driving method of the display panel according to the embodiment of the present application will be described by taking that N=2, i is an odd number, and j is an even number as an example. Referring to FIG. 11, for example, a charging period t110 of the first row of sub-pixels 120, a charging period t120 of the second row of sub-pixels 120, and the like are included within a frame t001. In a charging period of the sub-pixels 120 in odd rows (for example, the charging period t110 of the first row of sub-pixels), the charging ranking of the data lines 140 in odd columns is the first ranking, and the charging ranking of data lines 140 in even columns is the second ranking. In the odd rows, the luminance of the green sub-pixels G in even columns is relatively darker, and the luminance of the green sub-pixels G in odd columns is relatively brighter. In the charging period of sub-pixels 120 in even rows (for example, the charging period t120 of the first row of sub-pixels), the charging ranking of the data lines 140 in even columns is the first ranking, and the charging ranking of the data lines 140 in odd columns is the second ranking. In the even rows, the luminance of the green sub-pixels G in even columns is relatively brighter, and the luminance of the green sub-pixels G in odd columns is relatively darker.

Figure 12:
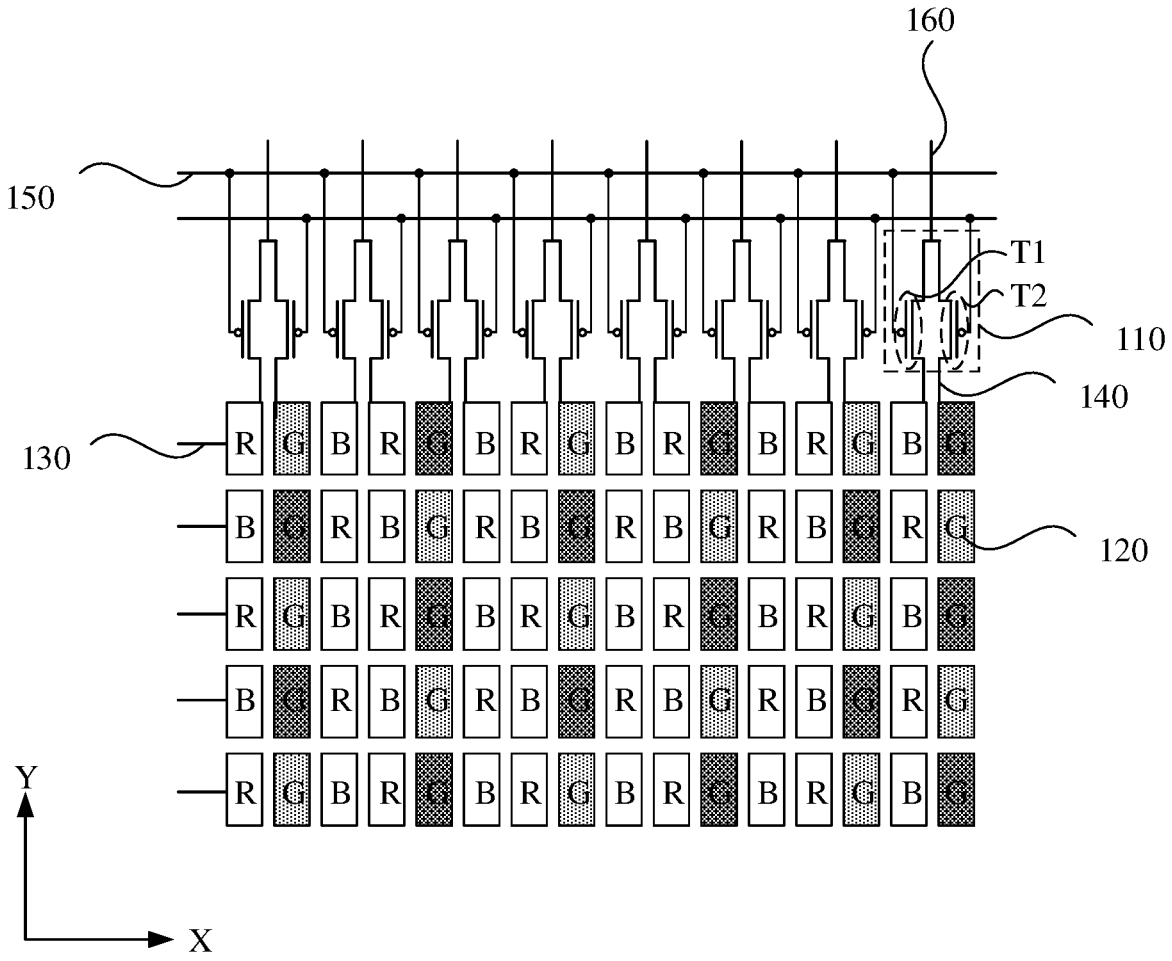
FIG. 12 is a schematic diagram of the luminance of the sub-pixels of the display panel shown in FIG. 10 according to an embodiment of the present application.

Referring to FIG. 11 and FIG. 12, a charging period t210 of the first row of sub-pixels 120, a charging period t220 of the second row of sub-pixels 120, and the like are included within another frame t002 adjacent to the frame t001. Within a charging period of the sub-pixels 120 in odd rows (for example, the charging period t210 of the first row of sub-pixels), the charging ranking of the data lines 140 in odd columns is the second ranking, and the charging ranking of the data lines 140 in even columns is the first ranking. In the odd rows, the luminance of the green sub-pixels G in even columns is relatively brighter, and the luminance of the green sub-pixels G in odd columns is relatively darker. Within a charging period of the sub-pixels 120 in even rows (for example, the charging period t220 of the second row of sub-pixels), the charging ranking of the data lines in even columns 140 is the second ranking, and the charging ranking of the data lines 140 in odd columns is the first ranking. In the even rows, the luminance of the green sub-pixels G in even columns is relatively darker, and the luminance of the green sub-pixels G in odd columns is relatively brighter.

In the embodiments of the present application, by exchanging the charging rankings of the data lines 140 every other frame, a green sub-pixel G in the same position of the display panel have a bright light-emitting state and a dark light-emitting state respectively in two adjacent frames, to form the brightness complementation, and the phenomenon of "vertical stripes" in vision due to uneven charging is eliminated.

Figure 13:
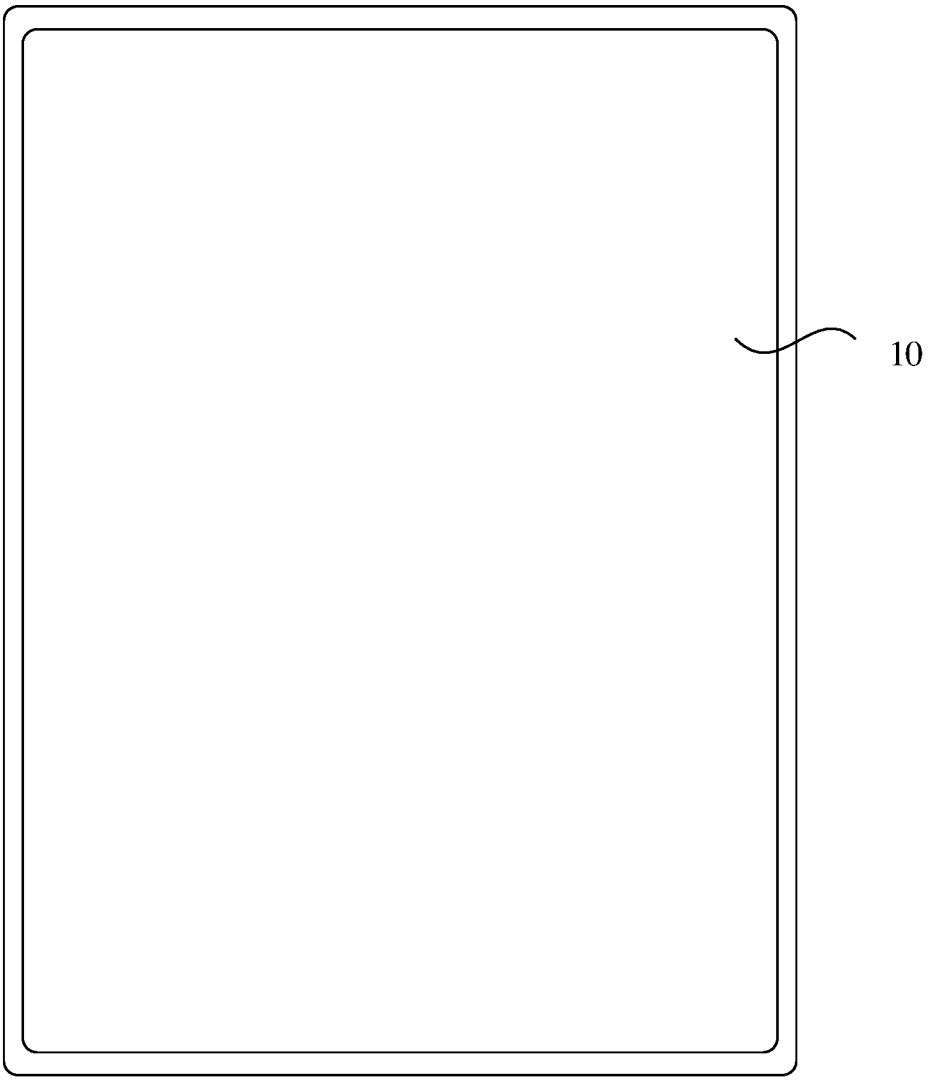
FIG. 13 is a structural diagram of a display device according to an embodiment of the present application.

The embodiments of the present application further provide a display device. Referring to FIG. 13, the display device includes a display panel 10 and a driving chip (not shown in FIG. 13). The driving chip is electrically connected to the display panel, and the display panel 10 is the display panel according to the embodiments of the present application. The driving chip drives the display panel to perform the driving method of the display panel 10 provided in any embodiment of the present application. The display device may be, for example, a mobile phone, a tablet computer, a display, and the like.

What is claimed is:

1. A driving method of a display panel, wherein the display panel comprises a plurality of multiplexing circuits, a plurality of sub-pixels, and a plurality of data lines and a plurality of scan lines electrically connected to the plurality of sub-pixels; and wherein each of the plurality of multiplexing circuits comprises N output ends, and each of the N output ends of each multiplexing circuit is electrically connected to one data line, each of the plurality of multiplexing circuits comprises a first output end and a second output end;

wherein the driving method of the display panel comprises: within one frame, charging, by each multiplexing circuit, in a charging period ti of a $i^{th}$ row of sub-pixels electrically connected to an $i^{th}$ scan line, N data lines electrically connected to the multiplexing circuit in a charging sequence of a first preset sequence, the first output ends of the plurality of multiplexing circuits output data signals to data lines in odd columns firstly, the second output ends of the plurality of multiplexing circuits output data signals to data lines in even columns secondly, within the charging period ti of the $i^{th}$ row of sub-pixels, a charging ranking of the data lines in the odd columns is a first ranking, and a charging ranking of the data lines in the even columns is a second ranking, the data lines in the odd columns charge the sub-pixels after a charging of the data signal is completed, while the data lines in the even columns charge the sub-pixels before the charging of the data signal is completed; and charging, by each multiplexing circuit, in a charging period tj of a $j^{th}$ row of sub-pixels electrically connected to a $j^{th}$ scan line, N data lines electrically connected to the multiplexing circuit in a charging sequence of a second preset sequence, the second output ends of the plurality of multiplexing circuits output data signals to data lines in the even columns firstly, the first output ends of the plurality of multiplexing circuits output data signals to data lines in the odd columns secondly, within the charging period tj of the $j^{th}$ row of sub-pixels, the charging ranking of the data lines in the odd columns is the second ranking, and the charging ranking of the data lines in the even columns is the first ranking, the data lines in the even columns charge the sub-pixels after the charging of the data signal is completed, while the data lines in odd columns charge the sub-pixels before the charging of the data signal is completed;

wherein the second preset sequence is different from the first preset sequence, and charging rankings of each data line electrically connected to each multiplexing circuit in at least two charging sequences are different, N is an integer and $N \geq 2$, i and j are positive integers and $j \neq i$, i is an odd number and j is an even number, within another frame adjacent to the one frame, charging, by each multiplexing circuit, in the charging period of sub-pixels electrically connected to the ith scan line, the N data lines electrically connected to the multiplexing circuit in the charging sequence of the second preset sequence; and charging, by each multiplexing circuit, in the charging period of sub-pixels electrically connected to the jth scan line, the N data lines electrically connected to the multiplexing circuit in the charging sequence of the first preset sequence, wherein some of the plurality of data lines in odd columns and even columns are respectively electrically connected to the plurality of sub-pixels emitting light of a same color and disposed in rows and columns, the other of the plurality of data lines in odd columns and even columns are respectively electrically connected to the plurality of sub-pixels emitting light of different colors and disposed in rows and columns, wherein the plurality of sub-pixels emitting light of a same color are arranged one by one in each of the columns, the plurality of sub-pixels emitting light of different colors are arranged alternately in each of the columns, wherein the plurality of sub-pixels emitting light of a same color are green sub-pixels, the plurality of sub-pixels emitting light of different colors are red sub-pixels and blue sub-pixels, wherein a pattern of the plurality of sub-pixels emitting light of the same color and the different colors is repeated in every M columns of the plurality of data lines, wherein $6 \leq M$.

2. The driving method of claim 1, wherein a charging sequence of the N data lines charged by each multiplexing circuit which is electrically connected to the N data lines changes once every k scan lines, and k is an integer larger than 1.

3. The driving method of claim 2, wherein k≤8.

4. The driving method of claim 1, wherein a charging sequence of the N data lines charged by each multiplexing circuit which is electrically connected to the N data lines repeats once every $(A_N^N+1)$ scan lines.

5. The driving method of claim 1, wherein N≤6.

6. The driving method of claim 1, after charging the N data lines electrically connected to each multiplexing circuit by the multiplexing circuit, further comprising:

sending, by a scan driving circuit, a scan signal to each of the plurality of scan lines and controlling sub-pixels electrically connected to each of the plurality of scan lines to be charged.

7. The driving method of claim 1, further comprising:

in a charging period of sub-pixels electrically connected to each of the plurality of scan lines, when each multiplexing circuit charges a data line corresponding to a last charging ranking in a charging sequence, a scan driving circuit sending a scan signal to each of the plurality of scan lines and controlling the sub-pixels electrically connected to each of the plurality of scan lines to be charged.

8. A display panel, comprising:

a plurality of multiplexing circuits;

a plurality of sub-pixels; and a plurality of data lines and a plurality of scan lines electrically connected to the plurality of sub-pixels;

wherein each of the plurality of multiplexing circuits comprises N output ends, each of the N output ends of each multiplexing circuit is electrically connected to one data line; and a driving method of the display panel uses the method of claim 1.

9. The display panel of claim 8, wherein a charging sequence of the N data lines charged by each multiplexing circuit which is electrically connected to the N data lines changes once every k scan lines, and k is an integer larger than 1.

10. The display panel of claim 8, wherein a charging sequence of the N data lines charged by each multiplexing circuit which is electrically connected to the N data lines repeats once every $(A_N^N+1)$ scan lines.

11. The display panel of claim 8, after charging the N data lines electrically connected to each multiplexing circuit by the multiplexing circuit, further comprising:

sending, by a scan driving circuit, a scan signal to each of the plurality of scan lines and controlling sub-pixels electrically connected to each of the plurality of scan lines to be charged.

12. A display device, comprising: a display panel and a driving chip; wherein the driving chip is electrically connected to the display panel, and the display panel is the display panel of claim 8.

13. The display device of claim 12, wherein i is an odd number and j is an even number.

14. The display device of claim 12, wherein a charging sequence of the N data lines charged by each multiplexing circuit which is electrically connected to the N data lines changes once every k scan lines, and k is an integer larger than 1.

15. The display device of claim 12, wherein a charging sequence of the N data lines charged by each multiplexing circuit which is electrically connected to the N data lines repeats once every $(A_N^N+1)$ scan lines.

16. The display device of claim 12, after charging the N data lines electrically connected to each multiplexing circuit by the multiplexing circuit, further comprising:

sending, by a scan driving circuit, a scan signal to each of the plurality of scan lines and controlling sub-pixels electrically connected to each of the plurality of scan lines to be charged.

* * * * *